United States Patent [19]

Hart et al.

[11] Patent Number: 4,830,148

[45] Date of Patent: May 16, 1989

[54] TRUSS-TYPE BRAKE BEAM FOR RAILWAY VEHICLE TRUCK-MOUNTED BRAKE ASSEMBLY

[75] Inventors: James E. Hart, Trafford; Earl E. Allan, Monroeville; Allen W. Kyllonen, Plum, all of Pa.

[73] Assignee: American Standard Inc., Wilmerding, Pa.

[21] Appl. No.: 77,570

[22] Filed: Jul. 24, 1987

[51] Int. Cl.[4] ..... B61H 13/36

[52] U.S. Cl. ..... 188/52; 188/219.1; 188/223.1; 188/228.6; 188/229.1; 188/231

[58] Field of Search ..... 188/225.6, 226.1, 228.1, 188/228.6, 233.7, 52, 49, 56, 207, 219.1, 219.6, 222.1, 223.1, 223.6, 224.1, 229.1, 229.6, 231, 232, 233.3, 53, 54, 55

[56] References Cited

U.S. PATENT DOCUMENTS

| | | | |
|---|---|---|---|
| 468,830 | 2/1892 | Schoen | 188/228.6 |
| 617,773 | 1/1899 | Rote | 188/229.1 X |
| 829,673 | 8/1906 | Sage | 188/228.6 |
| 980,517 | 1/1911 | Handiges | 188/228.6 |
| 1,493,964 | 5/1924 | Crone | 188/228.6 |
| 2,517,747 | 8/1950 | Whitney | 188/228.6 X |
| 3,298,474 | 1/1967 | Roselius et al. | 188/52 X |
| 3,907,078 | 9/1975 | Means | 188/219.1 X |
| 4,613,016 | 9/1986 | Hart et al. | 188/52 |

FOREIGN PATENT DOCUMENTS

| | | | |
|---|---|---|---|
| 8215 | 3/1980 | United Kingdom | 188/228.1 |

*Primary Examiner*—George E. A. Halvosa
*Attorney, Agent, or Firm*—G. J. Falce

[57] ABSTRACT

A truss-type brake beam having a bent configuration in which the compression and tension members are bent on opposite sides of a strut member, so that the compression and tension member segments lie in separate planes that intersect to form an angle therebetween, the line of intersection being rectilinear. The bent configuration of the brake beam accommodates housing of a brake cylinder in the pocket between the compression and tension members adjacent the strut member, facilitates passage of force-transmitting rods between the companion brake beams of a given truck, and permits application of brake beam actuating forces without imparting torque moments to the beam.

25 Claims, 3 Drawing Sheets

FIG. 3
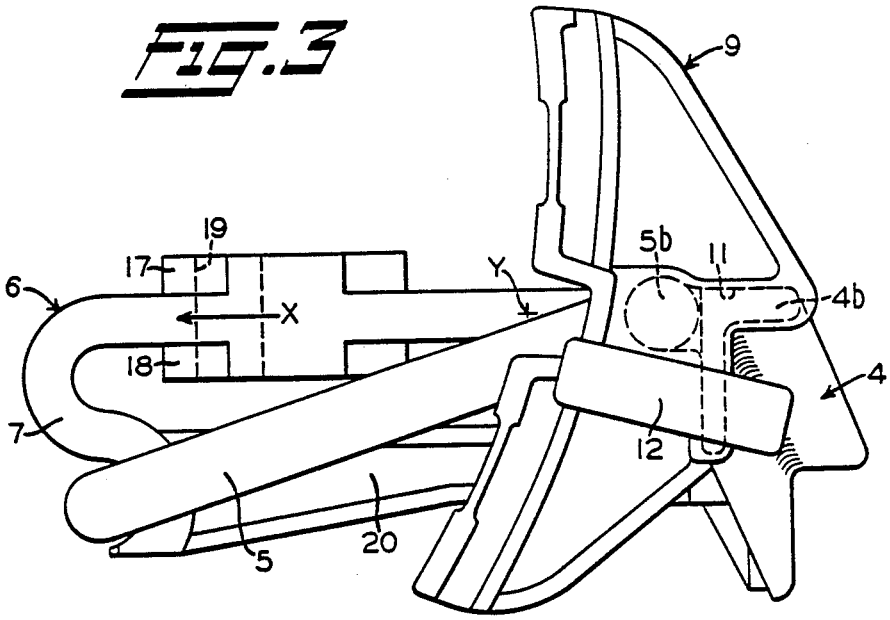
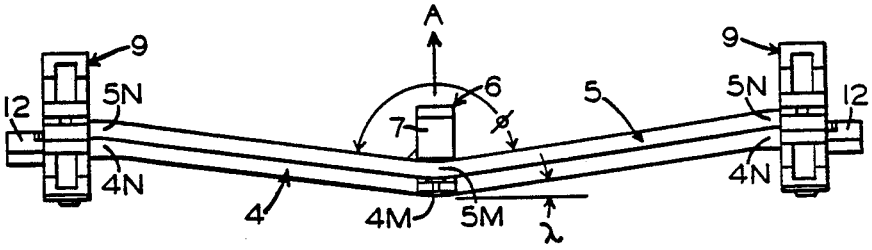
FIG. 4

TRUSS-TYPE BRAKE BEAM FOR RAILWAY VEHICLE TRUCK-MOUNTED BRAKE ASSEMBLY

BACKGROUND OF THE INVENTION

The present invention relates to truss-type brake beams for railway cars and, particularly, to truss-type brake beams as employed in truck-mounted brake assemblies, such as disclosed in U.S. Pat. No. 4,613,016, assigned to the assignee of the present invention.

The outstanding attribute of conventional, truss-type brake beams is the ability of these beams to resist bending during the application of braking force without requiring the use of excessively large structural components. It is important to note that these conventional brake beams are generally flat in shape, resulting in the unbalanced torque forces in the beams during brake applications. With the advent of truck-mounted brake assemblies, in which the brake cylinder device is mounted on the brake beam as opposed to mounting on the car body in conventional rigging arrangements, non-conventional or custom-designed brake beams were employed. These non-conventional brake beams were generally flat in shape, also. Because these non-conventional brake beams were required to support the weight of the brake cylinder, as well as the braking forces, heavy and rather cumbersome brake beams evolved which were expensive to manufacture. This severely limited the commercial viability of truck-mounted brake assemblies for railway cars.

More recently, truck-mounted brake assemblies have undergone design innovations to permit use of conventional, truss-type brake beams in order to enhance their commercial acceptance, one such design being that disclosed in the above-mentioned U.S. Pat. No. 4,613,016, the subject matter of which is incorporated herein by reference. In this design, a brake cylinder is located in the space between the compression and the tension members adjacent the strut bar that separates the beam compression and tension members. A force-transfer lever is pivotally attached to the strut bar, being connected at one end to the brake cylinder piston push rod and at the other end to a force-transmitting rod that transmits the brake cylinder force to the force-transfer lever of the opposite brake beam. It will be appreciated, therefore, that considerable space is required between the beam compression and tension members to accommodate both the brake cylinder and the force-transfer lever.

The space provided between the beam compression and the tension members, however, is limited by the proximity of other components of the truck to the compression and tension members, such as the truck bolster and the wheel/axle unit, between which the brake beam is operatively disposed. Accordingly, conventional flat-type truss beams are not completely satisfactory for use in these innovative truck-mounted brake assemblies, particularly where the installation requires a relatively large size brake cylinder.

OBJECTS OF THE INVENTION

It is, therefore, the main object of the present invention to provide a lightweight, yet strong truss-type brake beam that is suitable for use in a truck-mounted brake assembly of the type discussed.

It is a further object of the invention to configure a truss-type brake beam to accommodate mounting of both a brake cylinder device and a force-transfer lever in the space normally provided between the compression and the tension members adjacent the strut member.

It is another object of the invention to provide a novel truss-type brake beam for a truck-mounted brake assembly that is free of interference with the truck components.

It is yet another object of the invention to provide a novel, truss-type brake beam in accordance with the foregoing that is free of torque moments during braking.

It is a final object of the invention to provide a truss-type brake beam in accordance with the foregoing that lends itself to simple manufacturing practice.

BRIEF SUMMARY OF THE INVENTION

Briefly, according to the present invention, there is provided a truss-type brake beam comprising a compression member and a tension member, each having a bend in the same direction intermediate the ends thereof, which ends are fixed together, as by welding, for example, and a strut member interposed between the compression and the tension members at the bend therein. The strut member includes means for receiving a brake actuating force at a location that is upraised from the bend in the tension member. Typically, this brake actuating force receiving means is a bore in which the pivot pin of a force transfer lever or levers are mounted. Since the area of rotation of the transfer lever lies above the tension member, its pivot point can be moved nearer to the tension member without interference therewith and, in addition, provide more room to mount the brake cylinder in the space between the compression and tension members.

BRIEF DESCRIPTION OF THE DRAWINGS

The foregoing objects and other advantages of the invention will be better understood from the following more detailed explanation, when taken in conjunction with the accompanying drawings in which:

FIG. 3 is an end view of the brake beam of FIG. 2; and

FIG. 4 is a front view of the brake beam of FIG. 2.

DESCRIPTION AND OPERATION

Figure 1:
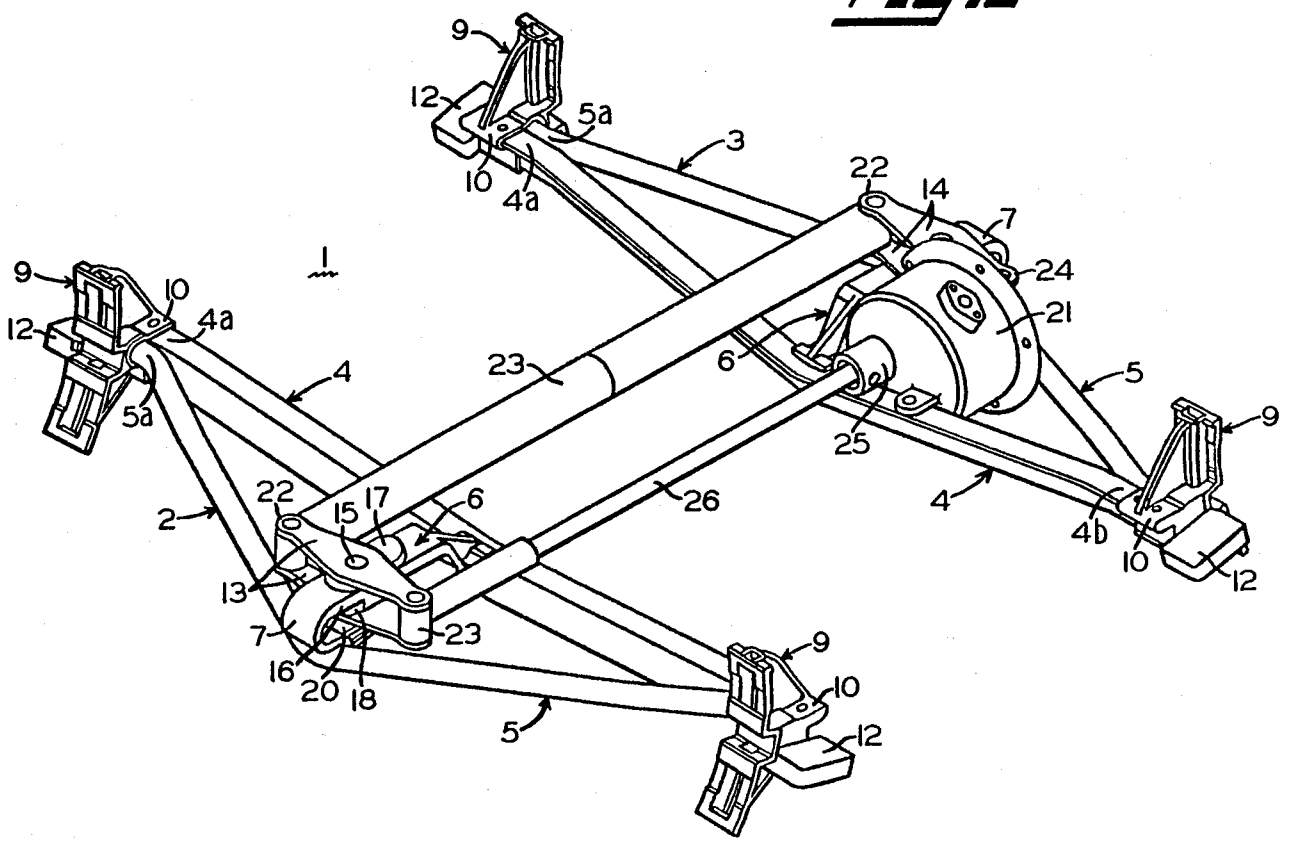
FIG. 1 is an isometric view of a single-cylinder, truck-mounted brake assembly for a railway vehicle employing truss-type brake beams according to the present invention.

Referring to FIG. 1, there is shown a single-cylinder, truck-mounted brake assembly 1 for a railway car that, except for the brake beams, is similar to the brake assembly shown in U.S. Pat. No. 4,613,016. In that a brake assembly of this type requires but a single brake cylinder per truck, potential exists for considerable cost savings over more traditional brake assemblies, particularly when used with low-cost, truss-type brake beams, according to the present invention. These brake beams 2 and 3 are substantially identical, each comprising a compression member 4, a tension member 5, and a strut member 6. Compression member 4 may be formed from angle iron stock, while tension member 5 may be formed from bar stock. The opposite ends of the compression and the tension members may be permanently connected together, preferably by welding along an outer segment 4a–5a, 4b–5b at the opposite ends of the compression member 4 and the tension member 5. At a location midway between their opposite ends, the compression member and the tension member of the respective beams 2 and 3 are spaced apart sufficiently to allow connection of the strut member 6 therebetween.

An exemplary brake beam 2 is illustrated in FIG. 4, in which the fixed opposite ends of the compression and tension members are displaced upwardly, from a generally horizontal plane, in which the midpoint of the compression and tension members lie. The upward direction is indicated by the direction of arrow A in FIG. 4 of the drawings. To achieve this bent brake beam configuration, the compression and the tension members 4, 5 are each formed at their midpoint with a bend 4M, 5M forming an angle $\phi$ of approximately 165°, as viewed in FIG. 4. In addition, the angularly disposed compression and the tension members are each formed with another bend 4N, 5N to locate the outer beam segments 4a–5a, 4b–5b, which may be in a generally horizontal plane, as viewed in the drawings. These bends 4m, 5m and 4N, 5N are such that the compression and the tension members are each disposed, on opposite sides of their midpoint, at an angle of approximately 7.5° with the horizontal. Although not perceptible in the drawings, in actual practice, the straight portions of tension member 5, between bends 5N and 5M, may be pre-formed with a slight bend proximate bends 5N. These bends are conventional, being for the purpose of relieving forces on the welded ends of the compression and tension members during loading.

Figure 2:
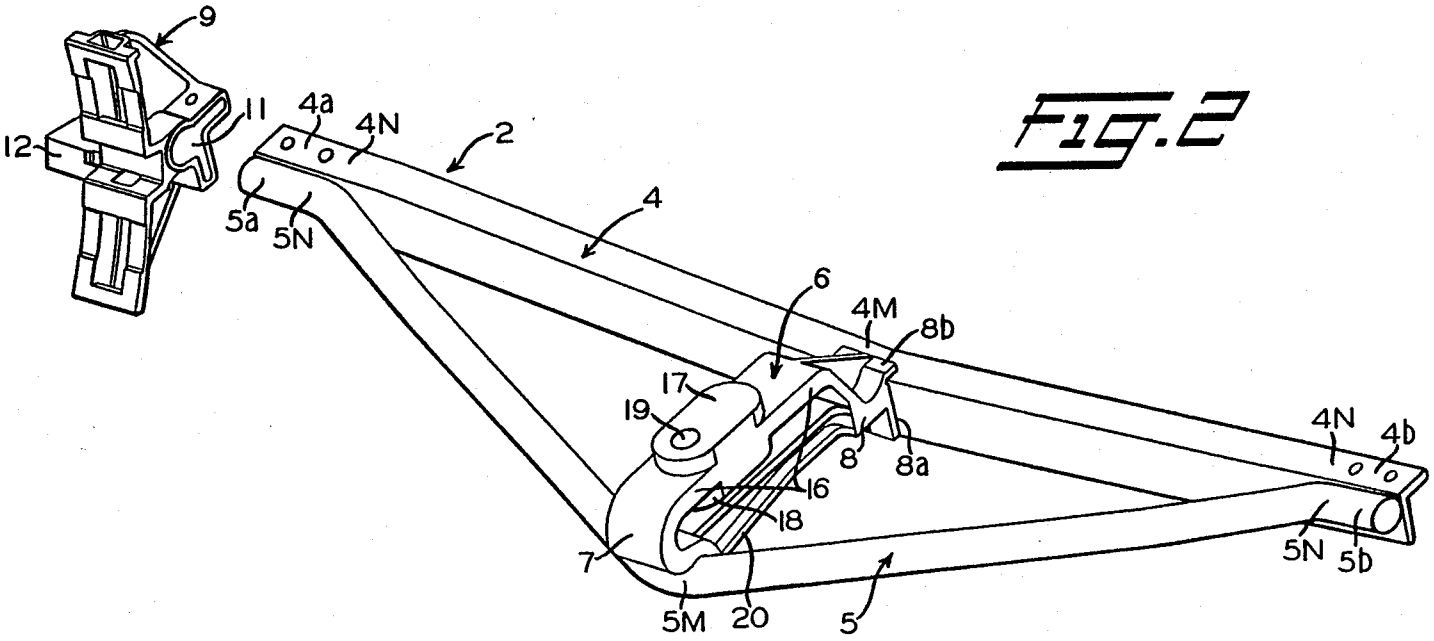
FIG. 2 is an enlarged isometric view showing a truss-type brake beam, as employed in FIG. 1.

As best seen in FIG. 2, strut member 6, interposed between the compression member 4 and the tension member 5, is provided with a generally S-shaped end 7, the lower convolution of which conforms with the shape of the tension member 5 at its bend 5M, so as to interfit therewith. The upper convolution of the S-shaped end 7 bears against the upper surface of the tension member 5 to provide a means of further supporting this end 7 of the strut member 6. The other end 8 of strut member 6 is formed with a flat frontal surface 8a that bears against the vertical flange of the compression member 4, and an upper flange 8b that bears against the top of the compression member 4, to provide a means of supporting the end 8 of strut member 6. These end configurations of strut member 6 allow the strut member 6 to be held in place under compression between the compression and the tension members, while at the same time supporting the weight of the brake components, which are mounted on the strut member, as hereinafter discussed. Bolts or rivets may be employed to securely fasten the frontal surface 8a to the vertical flange of the compression member, as a safety measure to prevent the strut member from becoming displaced.

Mounted on the respective outer end segments 4a–5a, 4b–5b of the brake beam 2 are brake heads 9, which are removably-secured thereto by riveting to the upper flange of the compression member 4. Two easily accessible rivets 10 are contemplated for this purpose. These brake heads 9 are formed with a channel 11 having a shape conforming generally to the end section of outer segments 4a–5a, in order to obtain a fit therebetween. In actual practice, the channel shape corresponding to the tension member is sufficiently large to compensate for manufacturing tolerances and thus assembly without binding. As is well known, brake heads 9 are provided with guide lugs 12 that ride in slots formed in the truck side frame (not shown) to support the brake beam, the brake heads being adapted to carry brake shoes (also not shown).

A pair of bifurcated transfer levers 13 and 14 are pivotally-connected by pins 15 to strut member 6 of the respective brake beams 2 and 3. An upper strap 16 of strut member 6 interconnects the upper convolution of the S-shaped end 7 with the upper flange 8b of the other end 8 of strut member 6. A boss 17 is formed on the upper side of strap 16, and a boss 18 is formed on the under side of strap 16. A bore 19 in strap 16 passes through bosses 17 and 18 and receives pin 15 to provide the pivotal connection of the respective force-transfer levers thereto. Bosses 17 and 18 provide upper and lower bearing surfaces on which the bifurcated arm segments of a respective one of force-transfer levers 13, 14 are supported, one arm segment passing over the strap 16 and the other arm segment passing under the strap 16 via an opening between the strap 16 and a lower support member 20. The strength of strut member 6, necessary to support the braking forces between the compression and the tension members without buckling, is provided primarily by this lower support member 20, which lies essentially in a direct line between the compression and the tension members. The purpose of the upper strap 16, on the other hand, is to locate and support the respective force-transfer lever, both with respect to its longitudinal position relative to the tension member 5 and to its vertical position relative to the ends of the brake beam.

In that upper strap 16 is upraised from the midpoint of tension member 5, as clearly illustrated in FIG. 3, the force-transfer lever rotates above the tension member 5 in that area covered by its arc of rotation. This permits the force-transfer lever to be located further rearward toward the tension member 5 than would otherwise be possible with a standard flat-shaped beam. Accordingly, this rearward location of the force-transfer lever provides more room to locate a brake cylinder device 21 within the pocket formed between the spaced-apart compression and tension members, without the risk of interference between the respective force-transfer lever and the tension member. Consequently, the overall dimension between the brake beam compression member and the tension member need not be increased to the point where these members might possibly interfere with the truck bolster and the wheel/axle unit.

Each end 22 of the respective force-transfer levers 13 and 14 is interconnected via a force-transmitting member 23, which may be in the form of n automatic slack adjuster device. The opposite end 24 of force-transfer lever 13 is connected to the pressure head 25 of the brake cylinder device 21 via a force-transmitting member 26. Because of the upraised mounting location of the respective force-transfer levers, and the fact that the midsection of compression member 4 is bent with its respective ends in an upward direction, force-transmitting members 23 and 26 pass over the top of the compression member 4 of the respective brake beams 2 and 3, thus requiring no opening through the brake beam compression member to accommodate passage of these force-transmitting members.

A piston rod of brake cylinder device 21 is connected to the opposite end 23 of force-transfer lever 14. Brake cylinder device 21 is suitably connected to the strut member 6 adjacent one side thereof and to the compression member 4 in the space between the compression member 4 and the tension member 5. The weight of the brake cylinder device and the force-transmitting members is thus carried by brake beams 2 and 3, which are, in turn, supported by the truck side frame (not shown), as mentioned above.

When a brake application is made, pressurization of the brake cylinder device 21 results in actuation of the brake cylinder piston rod in a direction to effect counterclockwise rotation of force-transfer lever 14, as viewed in FIG. 1. The force-transfer lever 14, in turn, actuates the force-transmitting member 23 to effect counterclockwise rotation of the force-transfer lever 13 and consequent actuation of the force-transmitting member 26. The force-transfer levers and the force-transmitting members, including the brake cylinder device, comprise a brake beam actuating linkage that interconnects brake beams 2 and 3 at pivot pins 15. The brake actuation force developed at brake cylinder device 21 is transmitted to brake beams 2 and 3 via pivot pins 15, as shown in FIGS. 1 and 3. The brake actuation forces effectively act along pin 15. The resultant of these forces is shown at X. Since the length of the force-transmitting member 23 increases with actuation of the brake cylinder push rod during brake applications, it follows that brake beams 2 and 3 are moved apart by the brake beams linkage until the brake shoe engagement with the vehicle wheels occurs.

The brake actuation force is transmitted to the brake shoes through the strut member 6, the tension member 5, the fixed outer end segments 4*a*–5*a*, 4*b*–5*b* of the respective brake beams, the compression member 4, and the brake heads 9. Theoretically, the normal force produced along the length of the brake shoes carried by brake heads 9, to the wheel, may be represented by a resultant force, this resultant force being effective at a point generally midway along the brake shoe surface between its ends. Ideally, this point at which the resultant brake application force X acts at the respective brake shoes should be in a plane of elevation that passes through the center midpoint of the bore 19, thereby assuing the absence of unbalanced torque forces on the brake beam. However, because of brake shoe wear, end guide lug wear, the angle at which the brake beams are moved toward brake engagement with the wheels, etc., the point at which the resultant application force acts may vary with respect to its vertical position. Therefore, a point Y has been chosen, substantially at the midpoint of the brake head force, as representative of the point at which the resultant brake application force acts. Point Y thus represents the average location of the various points at which the resultant application force acts for the different conditions that influence its location. While the actual point at which the resultant brake application force acts will deviate slightly from point Y under most conditions, producing slight torque moments on the beam, these torque moments will be so small as to be inconsequential. It will be appreciated that, if the actual point at which the resultant brake application force acts were employed under new shoe conditions, for example, torque on the beam would initially be zero, but would increase from zero as the brake shoe became worn, so that when completely worn, the vertical location of the resultant brake application force would change considerably, and the torque on the beam would be greater than in choosing a compromise point Y. For this reason, it is desirable to locate point Y midway along the brake head face.

It will be appreciated now that the upper strap 16 of strut member 6 raises the point at which the brake forces are applied, i.e., X in FIG., to a height above the downwardly-angled center section of the compression and tension members 4, 5, corresponding to the level of points Y. As is shown in FIG. 3, the resultant of the brake actuation force X and the resultants of the brake application forces at points Y lie in a common horizontal plane. Thus, brake forces are transmitted from brake beams 2, 3 to the vehicle wheels with essentially no external torque forces acting on the beam.

In addition, the internal torque forces on the beam compression and tension members are eliminated, by angling these members laterally upward from their midpoint, so that the ends of the compression and tension members engage the brake head in channel 11 substantially in line with the center of brake shoe force. In this manner, there are no moment arms via which the brake actuation force is applied and the compression and tension members only have to be sufficiently strong to withstand pure tension and compression and the normal small amount of bending.

From the foregoing, it will be understood that the bent beam configuration of the present invention not only allows the force-transfer lever to be located closer to the tension member without interference therebetween (to provide room to house the brake cylinder), due to its vertical position above the downwardly-angled tension member, but further assures that this vertical position of the force-transfer lever is at a height that prevents any significant torque forces from acting on the beam during braking. Moreover, the upraised location of the force-transfer lever, combined with the downwardly-angled compression member, allows the force-transmitting members to pass over the compression members of the respective brake beams, so as to not require openings in the beam to accommodate passage of these force-transmitting members between the respective brake beams.

We claim:

1. A truss-type brake beam including a compression member, a tension member having its opposite ends fixed to the respective opposite ends of said compression member, a strut member interconnected between said compression and tension members, and brake means mounted on the opposite ends of at least one of said compression and said tension members for transmitting a brake application force to a railway vehicle wheel, wherein the improvement comprises:

(a) said compression member having a bend intermediate said opposite ends thereof, said opposite ends of said compression member extending angularly from said bend therein so that corresponding points of said opposite ends thereof lie in a plane displaced from said bend therein;

(b) said tension member having a bend intermediate said opposite ends thereof, said opposite ends of said tension member extending angularly from said bend therein so that corresponding points of said opposite ends thereof lie in said plane so as to be displaced from said bend therein; and (c) said strut member having means for receiving a brake beam actuating force including a bore adapted to receive said brake beam actuating force, said plane intersecting said bore and being perpendicular to the axis thereof, whereby said brake beam actuating force is generally in said plane with said brake application force provided by said brake means.

2. A truss-type brake beam, as recited in claim 1, wherein said strut member is interconnected between said compression and said tension members at said bend intermediate said opposite ends thereof.

3. A truss-type brake beam, as recited in claim 2, wherein said bend intermediate said opposite ends of said compression and said tension members is generally midway between said opposite ends thereof.

4. A truss-type brake beam, as recited in claim 3, wherein the angle of said bend intermediate said opposite ends of said compression member is substantially the same as the angle of said bend intermediate said opposite ends of said tension member.

5. A truss-type brake beam, as recited in claim 4, wherein said angle between said angularly disposed compression and said tension members is substantially 165°.

6. A truss-type brake beam, as recited in claim 4, wherein said axis of said bore is displaced longitudinally along said strut member from a line extending between said fixed opposite ends of said compression and tension members.

7. A truss-type brake beam, as recited in claim 6, wherein said longitudinal displacement of said axis of said bore is in the direction of said tension member.

8. A truss-type brake beam, as recited in claim 7, wherein said compression and said tension members are each provided with another bend between said fixed opposite ends thereof and said intermediate bend.

9. A truss-type brake beam, as recited in claim 8, wherein the angle of said other bends of said compression and said tension members is the same.

10. A truss-type brake beam, as recited in claim 9, wherein said angle formed by said other bend is such that said opposite ends of said compression and tension members lie parallel to said plane.

11. A truss-type brake beam as recited in claim 10, wherein said brake means comprises a brake head adapted to receive a friction brake shoe, said brake head having a channel formed therein with a shape conforming substantially to the shape of the end section of said fixed opposite ends of said compression and tension members.

12. A truss-type brake beam as recited in claim 11, wherein said tension member is formed from bar stock and said compression member is formed from angle iron stock.

13. A truss-type brake beam as recited in claim 12, wherein the vertical flange of said angle iron stock forming said compression member bears against a vertical wall of said brake head channel whereby said brake actuation force is transmitted from said compression member to said brake head to provide said brake application force.

14. For a railway vehicle truck having at least two wheel/axle units, a brake rigging comprising:

(a) first and second truss-type brake beams interposed between said at least two wheel/axle units in spaced-apart relationship therebetween, at least one of said first and said second brake beams comprising:
  (i) a compression member having a bend intermediate the opposite ends thereof;
  (ii) a tension member having a bend intermediate the opposite ends thereof in the same direction as said bend in said compression member, said opposite ends of said compression and said tension members being fixed together;
  (iii) a strut member interconnected between said compression and said tension members intermediate said fixed opposite ends such that said compression and said tension members are in spaced-apart relationship;
(b) brake means mounted on each end of at least one said compression and tension member for applying a brake application force to said wheel/axle units;
(c) first and second force-transfer levers, each having a pivotal connection with said strut member of a respective one of said first and said second brake beams;
(d) first force-transmitting means connected between corresponding arms of said first and second force-transfer levers including a force actuator for effecting rotation of at least one of said first and said second force-transfer levers; and
(e) second force-transmitting means connected between the other arms of said first and said second force-transfer levers, whereby a brake actuating force is exerted on said first and said second brake means at said pivotal connections thereof in response to operation of said force actuator; and
(f) said pivotal connection of said force transfer lever with said strut member of said at least one brake beam being displaced relative to said connection of said strut member with said compression and tension members thereof, such that the resultant force of said brake actuating force lies in a plane passing through the points at which the resultant force of said brake application force acts at said brake means, the axis of rotation of said force-transfer lever of said at least one brake beam about said pivotal connection thereof being perpendicular to said plane.

15. The invention, as recited in claim 14, wherein said axis of rotation is displaced longitudinally along said strut member from a line extending between said points representing the resultant of said braking force at said brake means of said at least one of said first and said second beams.

16. The invention, as recited in claim 15, wherein said longitudinal displacement of said axis of rotation of one of said first and said second force-transfer levers is in the direction of said tension member of said brake beam on which said one of said first and said second force-transfer levers is pivotally connected.

17. The invention, as recited in claim 16, wherein said force actuator is located between said spaced-apart compression member and tension member of said at least one of said first and said second brake beams adjacent one side of said strut member thereof.

18. The invention, as recited in claim 14, wherein said compression member of each said brake beam slopes from said opposite ends thereof to said bend intermediate said opposite ends thereof, the angle of said bend establishing the degree of said slope such that said compression member is displaced from said plane sufficiently that said first and said second force-transmitting means are connected to the respective arms of said first and said second force-transfer levers with clearance relative to said compression members of said first and said second beams.

19. A truss-type brake beam for a railway car comprising:

(a) a compression member;
(b) a tension member fixed at the opposite ends thereof to the corresponding opposite ends of said compression member; and (c) a strut member interposed between said compression and said tension members at a location intermediate said opposite ends thereof to connect said compression and tension members in spaced-apart relationship between said opposite ends thereof, said compression and said tension members on one side of said strut member defining a first beam segment that lies in a first plane that intersects a second plane in which lies a second beam segment defined by said compression and said tension members on the other side of said strut member, said first and second planes forming an angle therebetween, said intersection of said first and second planes being a linear line; and (d) said strut member comprising means for receiving a brake beam actuating force including a bore having an axis perpendicular to said line of intersection of said first and second planes and to a third plane in which said opposite ends of said compression and tension members lie, said bore being displaced from said line of intersection of said first and second planes in the direction of said third plane.

20. A truss-type brake beam as recited in claim 19, wherein said strut member is interposed between said compression and tension members at said line of intersection of said first and second planes.

21. A truss-type brake beam as recited in claim 20, wherein said line of intersection of said first and second plane bisects said compression and tension members midway between said opposite ends thereof.

22. A truss-type brake beam as recited in claim 21, further comprising brake means mounted on said opposite ends of at least one of said compression and said tension members for transmitting a brake application force to the wheels of said railway vehicle.

23. A truss-type brake beam as recited in claim 22, wherein said brake beam actuating force effective at said strut member and said brake application force effective at said brake means act in said third plane.

24. A truss-type brke beam as recited in claim 23, wherein said means for receiving said brake beam actuating force comprises:

(a) a lower support portion having opposite ends connected to said compression and tension members;

(b) an upper strap displaced from said lower support portion in the direction of said third plane; and (c) said bore being located in said upper strap, said third plane passing through the point at which the resultant force of said brake beam actuating force acts midway along said bore.

25. A truss-type brake beam as recited in claim 24, wherein said brake means comprises a brake head having a brake shoe mounting face, said third plane passing through the point at which the resultant force of said brake application force acts midway along said brake shoe mounting face.

* * * * *